United States Patent [19]

Eckell et al.

[11] Patent Number: 4,599,293

[45] Date of Patent: Jul. 8, 1986

[54] TONER TRANSFER PROCESS FOR TRANSFERRING AND FIXING A TONER IMAGE BY MEANS OF FILM

[75] Inventors: Albrecht Eckell, Frankenthal; Albert Elzer; Gerhard Hoffmann, both of Otterstadt; Reinhold J. Leyrer, Ludwigshafen; Heinz-Ulrich Werther, Wachenheim, all of Fed. Rep. of Germany

[73] Assignee: BASF Aktiengesellschaft, Fed. Rep. of Germany

[21] Appl. No.: 327,728

[22] Filed: Dec. 4, 1981

[51] Int. Cl.[4] ..... G03G 13/16

[52] U.S. Cl. ..... 430/126; 430/281; 430/285

[58] Field of Search ..... 430/126, 281, 285, 124

[56] References Cited

U.S. PATENT DOCUMENTS

| | | | |
|---|---|---|---|
| 2,760,863 | 8/1956 | Plambeck | 430/281 X |
| 3,275,436 | 9/1966 | Mayer | 430/126 |
| 4,168,338 | 9/1979 | Kato et al. | 428/219 |
| 4,226,930 | 10/1980 | Takimoto et al. | 430/126 |

FOREIGN PATENT DOCUMENTS

| | | |
|---|---|---|
| 2401996 | 7/1974 | Fed. Rep. of Germany . |
| 2909992 | 10/1980 | Fed. Rep. of Germany . |
| WO79/00898 | 11/1979 | World Int. Prop. O. . |

*Primary Examiner*—John D. Welsh

*Attorney, Agent, or Firm*—Keil & Weinkauf

[57] ABSTRACT

To transfer a toner image from a toner-treated surface, a toner transfer film is employed, which comprises a transparent base carrying a transparent layer which is capable of picking up toner and has a temporary slight surface tack, the layer consisting of a mixture containing a polymeric and/or pre-polymeric binder, a polymerizable low molecular weight compound and a polymerization initiator. After transfer, the toner image can be permanently fixed to the toner transfer film by heating the film and/or exposing it to light.

3 Claims, No Drawings

TONER TRANSFER PROCESS FOR TRANSFERRING AND FIXING A TONER IMAGE BY MEANS OF FILM

The present invention relates to a toner transfer film for transferring and subsequently fixing toner images, in particular produced electrophotographically, which film consists essentially of a clear, transparent base to which is anchored a thin layer which is capable of picking up and binding the toner material. The invention also relates to processes for transferring toner images and for the production of a negative or positive of a toner image by means of such a film.

In electrophotography, the electrophotographic recording material, after having been charged electrostatically and subsequently been exposed imagewise, is treated with a liquid or powder toner, in general containing finely milled, polymer-coated pigment particles. This serves to develop the electrostatic charge image present after exposure, and normally results in faithful reproduction of the original.

After the treatment with toner, the latter can be directly fixed to an electrophotographic recording material by means of pressure or heat (thus giving a direct copy); alternatively, the toner image is transferred to a substrate. Substrates which can be used are paper, plastic sheets and films, metal foils and metal sheets. If paper is used, the copy is referred to as an indirect or normal paper copy. If the transferred toner image is to be employed for specific purposes, for example as an information store in reprography, suitable bases for toner image transfer are transparent plastic sheets or films.

This type of toner transfer usually presents various problems. Thus, rarely more than 70% of the original amount of toner in the image on the electrophotographic recording material is transferred. The fact that some of the toner is left behind means a substantial loss of information, which in particular in the case of transfer to transparent bases, for example plastic sheets or films, means less good optical density. Moreover, particularly in toner transfer to smooth surfaces, such as are frequently exhibited by plastic sheets, there is the danger that the toner image will be smudged during transfer or on detaching the base from the electrophotographic recording material, resulting in a high scrap rate. Moreover, on toner image transfer to, for example, smooth polyester film surfaces or similar film-like bases, there are also information losses due to static charges. In addition, permanent fixing of the toner image thus transferred can entail considerable problems.

It is an object of the present invention to provide an easily handled film suitable for toner image transfer, by means of which the picking up of the toner image from a toner-treated surface, especially from an electrophotographic or electroradiographic recording material which has been exposed imagewise, can be effected by a simple procedure without substantial loss of information, and the transferred toner image can subsequently be fixed in a simple manner, giving a durable and storage-stable product, so that the transfer film carrying the transferred toner image can be employed directly as an information store, for example as a positive or negative in reprography.

We have found, surprisingly, that this object is achieved if, to transfer a toner image, a transfer film is employed which consists essentially of a clear support or base which is transparent to light and, anchored thereto, a layer which has a temporary slight tack, is solid at room temperature and can undergo free radical polymerization.

Accordingly, the present invention relates to a toner transfer film for picking up a toner image from a toner-treated surface and then fixing the transferred toner image, which consists essentially of A. a clear, transparent base having a thickness of about 70–205 μm and B. a layer, firmly anchored thereto, which is also clear and transparent and is capable of picking up the toner image, which layer is solid and substantially colorless, has a temporary slight surface tack at least under the conditions of toner image transfer, has a thickness of about 0.8–90 μm and consists essentially of 1. 35–75% by weight, preferably 35–55% by weight, based on the sum of the components of layer B, of one or more polymeric and/or prepolymeric binders,
2. 20–64.9% by weight, preferably 30–48% by weight, based on the sum of the components of layer B, of one or more low molecular weight, ethylenically unsaturated compounds which are polymerizable by free radicals and have a boiling point above 100° C. at atmospheric pressure,
3. from 0.1 to 10% by weight, preferably from 0.5 to 6% by weight, based on the sum of the components of layer B, of one or more polymerization initiators which can be activated by heat or light and form free radicals and
4. from 0 to 30% by weight, preferably from 10 to 20% by weight, based on the sum of the components of layer B, of conventional additives.

The invention further relates to methods of transferring a toner image and of producing a durable, storage-stable negative or positive via a toner image by means of the novel toner transfer films, these methods being described in more detail below.

By using the novel toner transfer film, the picking-up and fixing of toner images from a toner-treated surface of electrophotographic or electroradiographic recording material which has been exposed image-wise can be effected very rapidly and simply. We have found, surprisingly, that using the novel toner transfer film permits more than 98% transfer of the toner without loss of information, for example as a result of smudging or ill-defined contour transfer. It was in no way foreseeable that this high toner transfer, which is very desirable in practice, would be achievable with a toner transfer film which has only a temporary slight surface tack. We have found—surprisingly for the skilled worker—that the extent of toner transfer depends only slightly, if at all, on the tack of the layer (B) applied to the base (A). It is a particular advantage that, when using the novel toner transfer film, the temporarily slightly tacky surface of the layer (B) can, after it has picked up the toner image from a toner-treated surface, be rendered completely non-tacky by simple process steps, for example heating and/or brief exposure to actinic light, and that the toner is at the same time rapidly and firmly bonded to the toner transfer film so that the transferred toner image is fixed thereon. This was in no way obvious to the skilled worker, who, moreover, could not foresee that this would provide a simple and easy way of obtaining an information store which is extremely stable on storage and free from yellowing and which can accordingly be employed as a positive or negative in reprography or X-ray diagnostics.

A suitable base for the novel toner transfer material is a film or sheeting which is clear and transparent, ie. which transmits light in the visible, and preferably also in the actinic, wavelength range. The light transmission of the film or sheeting used as the base should preferably be greater than 80%, in particular greater than 90%. This requirement is due to the fact that, after transfer and fixing of a toner image, the novel toner transfer film is intended to be used as an information store, for example as a positive or negative. The film or sheeting used as the base is in general colorless, so that the toner image, after transfer to the novel material, is clearly and distinctly discernible, without significant loss of information. However, it is also possible to employ slightly colored transparent film or sheeting as the base, provided its color differs greatly and markedly from that of the toner material. The film or sheeting used as the base for the novel toner transfer material should moreover advantageously be flexible and resilient, so that, for transfer of the toner image, the toner transfer film can easily and accurately be brought into contact with, and pressed against, the toner-treated surface. Since the film or sheeting base acts as a support, it should also be strong and dimensionally stable; in general, its thickness is about 70–205 μm, preferably 100–190 μm. Suitable materials for producing the base are any of the materials, in particular plastics, which can be employed to produce a film and which satisfy the above requirements. Specific examples of suitable bases are films or sheeting of polyethylene, polypropylene, styrene polymers, polyvinyl chloride, cellulose derivatives, polyurethanes, nylons and especially polyesters, eg. polyethylene terephthalate or polybutylene terephthalate.

The layer (B) of the novel toner transfer film, which serves to pick up the toner image from a toner-treated surface and to fix the transferred image, generally has a thickness of 0.8–90 μm, especially of 12–65 μm. It should be colorless, clear and transparent, for the same reasons as those given in discussing the base (A). The layer (B) of the toner transfer film which serves to pick up the toner image is solid and has a temporary slight tack, at least on the surface. Solid, in the present context, means that the layer (B) has very little, if any, creep under the temperature and pressure conditions of normal handling and use, but instead is dimensionally stable. Slightly tacky means that the layer (B), when touched, exhibits slight tack but, in contrast to films bearing a pressure-sensitive adhesive, is not self-adhesive, ie. cannot be regarded as an adhesive layer and exhibits, at most, a slight, non-permanent adhesion to other materials. The novel toner transfer film also differs from self-adhesive films in that the tack is only temporary, ie. the material can be rendered non-tacky by a suitable treatment. As will be explained below, the temporary slight tack of the surface of the layer (B) of the novel toner transfer film results from the composition of the layer (B), and is less important for high toner transfer than for good bonding of the toner material, ie. for adequate fixing of the transferred toner image. It is not necessary that the layer (B) of the novel toner transfer films should be a priori, ie. at ambient temperature and without use of pressure, have a slightly tacky surface; rather, it suffices, for transfer and fixing of the toner image, if the layer (B) acquires a slight surface tack under the conditions of toner image transfer, ie. under a pressure of about 0.2–4 bar, preferably of 0.6–2 bar.

The layer (B)—serving to transfer the toner image—of the novel toner transfer film is essentially composed of (1) one or more polymeric and/or prepolymeric binders, (2) one or more low molecular weight, ethylenically unsaturated, polymerizable compounds and (3) one or more free radical polymerization initiators, with or without (4) one or more additives.

Suitable binders for use in the layer (B) are polymeric and/or prepolymeric substances. These may be saturated or may still contain ethylenically unsaturated double bonds amenable to free radical polymerization. The polymeric binders in general have a molecular weight of from 10,000 to 1,000,000, preferably from 30,000 to 300,000. The prepolymeric binders, which are, in general, ethylenically unsaturated compounds amenable to free radical polymerization and/or crosslinking reactions, usually have a molecular weight of from 500 to 3,500. The polymeric binders are solid and, in general, non-tacky; the prepolymeric binders should also be solid, but may already possess, per se, a temporary slight tack.

Examples of suitable binders for use in the layer (B) are nylons, polyurethanes, saturated and unsaturated polyesters, polyester-urethanes and polyether-urethanes, styrene polymers, acrylate ester and methacrylate ester polymers and copolymers, polyvinyl alcohol and its derivatives, etc. Particularly suitable binders have proved to be polyester resins, polyphthalate resins, styrene/butadiene and styrene/isoprene random copolymers, styrene/(butadiene and/or isoprene) two-block copolymers, styrene/(butadiene and/or isoprene) three-block copolymers having one or two terminal styrene polymer blocks, styrene/maleic anhydride copolymers, acrylate ester and methacrylate ester polymers and copolymers, vinyl chloride polymers, vinyl chloride/vinyl acetate copolymers, alkyd resins, polyurethane-acrylate resins, polyester-acrylate resins, polyethylene glycol diacrylates and dimethacrylates, and polyvinyl alcohol and its esters, ethers and acetals.

The layer (B) may contain only one polymeric or prepolymeric binder, but mixtures of different, mutually compatible polymeric and/or prepolymeric binders may also be employed. Mixtures of polymeric and/or prepolymeric binders which have identical structure but different degrees of polymerization may also be used advantageously. For example, a binder consisting of a mixture of acrylate ester polymers or methacrylate ester polymers with different mean molecular weights has proved particularly advantageous. Suitable polymers of this type are in particular the polymers of alkyl acrylates and alkyl methacrylates where alkyl is of 1 to 8 carbon atoms, for example of methyl acrylate, methyl methacrylate, ethyl acrylate, ethyl methacrylate, butyl acrylate, butyl methacrylate, hexyl acrylte, hexyl methacrylate, 2-ethylhexyl acrylate and 2-ethylhexyl methacrylate. Copolymers of different acrylates and methacrylates of the stated type are also very suitable, for example copolymers of about 60% by weight of methyl methacrylate and 40% by weight of ethyl acrylate. The acrylate and methacrylate polymers have mean molecular weights of from 25,000 to 1,000,000. Furthermore, polyurethane-acrylates with mean molecular weights of from 800 to 3,500 have proved particularly advantageous binders. These can be prepared by, for example, reacting a diisocyanate with a diol or polydiol and a hydroxyalkyl acrylate or methacrylate. Other particularly preferred binders include polyester-acrylate resins with molecular weights of from 600 to 2,800, and three-block copolymers of styrene, butadiene and isoprene, which have one or two terminal styrene polymer blocks contain from 14 to 20% by weight of styrene as polymerized units, and have a mean molecular weight of from 30,000 to 150,000.

The low molecular weight ethylenically unsaturated compounds contained in layer (B) of the toner transfer film are required to be compatible with the binder of layer (B) and should in general have a boiling point of above 100° C. at atmospheric pressure. In particular, those low molecular weight ethylenically unsaturated compounds which are easily amenable to free radical-initiated polymerization are employed. These particularly include low molecular weight compounds of the acrylic type, ie. acrylates, methacrylates, acrylamide, methacrylamide, and their derivatives. The low molecular weight, ethylenically unsaturated compounds are preferably bifunctional or polyfunctional, ie. they have, per molecule, two or more ethylenically unsaturated double bonds polymerizable by free radicals. The bifunctional or polyfunctional low molecular weight ethylenically unsaturated compounds can be employed individually or as mixtures with one another. It is also possible to employ the bifunctional or polyfunctional low molecular weight ethylenically unsaturated compounds together with low molecular weight monofunctional ethylenically unsaturated compounds, ie. compounds which contain only one ethylenic polymerizable double bond in the molecule. If the binders employed are polymers which do not participate in the polymerization which occurs on after-treatment (to be described below), it is advantageous to employ solely bifunctional or polyfunctional low molecular weight ethylenically unsaturated compounds; at most, small amounts, in general up to 25%, but preferably not more than 15% by weight—based on the total of low molecular weight ethylenically unsaturated compounds used—of monofunctional low molecular weight ethylenically unsaturated compounds should be employed in such cases. On the other hand, in cases where the binder consists of unsaturated polymers and/or, in particular prepolymers which participate in polymerization on after-treatment it is advantageous to employ mixtures of bifunctional or polyfunctional and monofunctional low molecular weight ethylenically unsaturated compounds, in which mixtures the proportion of the monofunctional compounds is from 25 to 60% by weight, preferably from 25 to 40% by weight, based on the sum of all the low molecular weight ethylenically unsaturated compounds. If the binder consists solely of prepolymeric unsaturated compounds, for example polyurethane-diacrylates or polyester-diacrylates, it is even possible, at times, to employ exclusively monofunctional low molecular weight ethylenically unsaturated compounds in layer B.

Examples of bifunctional or polyfunctional low molecular weight ethylenically unsaturated compounds are allyl acrylate, diallyl phthalate, butane-1,4-diol divinyl ether and, in particular, the diacrylates, triacrylates and tetraacrylates, and correspoding methacrylates of diols, triols or tetraols. Specific examples are ethylene glycol diacrylate, ethylene glycol dimethacrylate, butane-1,4-diol diacrylate, butane-1,4-diol dimethacrylate, tetraethylene glycol diacrylate and dimethacrylate, hexanediol diacrylate and dimethacrylate, diethylene glycol diacrylate and dimethacrylate, triethylene glycol diacrylate and dimethacrylate, polyethylene glycol diacrylates and dimethacrylates of molecular weight up to about 500, propane-1,2-diol diacrylate and dimethacrylate, propane-1,3-diol diacrylate and dimethacrylate, neopentyl glycol diacrylate and dimethacrylate, glycerol diacrylate and triacrylate and the corresponding methacrylates, trimethylolpropane diacrylate and triacrylate and the corresponding methacrylates, as well as the acrylates and methacrylates of pentaerythritol. Further examples of bifunctional or polyfunctional low molecular weight ethylenically unsaturated compounds are acrylamide and methacrylamide derivatives, for example ethylene glycol bis-acrylamide and bis-methacrylamide, methylene-bis-acrylamide and -bis-methacrylamide, and the like.

Examples of suitable monofunctional low molecular weight ethylenically unsaturated compounds are acrylic acid and methacrylic acid themselves and, in particular, the acrylates and methacrylates of monoalcohols of 1 to 8 carbon atoms, eg. methyl acrylate, methyl methacrylate, ethyl acrylate, ethyl methacrylate, butyl acrylate, butyl methacrylate, hexyl acrylate, hexyl methacrylate, 2-ethylhexyl acrylate and 2-ethylhexyl methacrylate. Other examples are the monoacrylates and monomethacrylates of diols, triols and other polyhydric alchols, in particular the monoacrylates and monomethacrylates of ethylene glycol, 1,4-butanediol, diethylene glycol, triethylene glycol and tetraethylene glycol.

The nature of the low molecular weight ethylenically unsaturated compounds employed depends in particular on the nature of the binder used and, as already mentioned, particular attention must be given to the compatibility of the low molecular weight ethylenically unsaturated compounds with the binder.

It is also necessary to correlate the amounts of the binder and of the low molecular weight ethylenically unsaturated compounds. In general, the amounts are such that the proportion of binder is from 35 to 75% by weight, preferably from 35 to 55% by weight, of the sum of all components of layer B. The proportion of low molecular weight ethylenically unsaturated compounds is in general from 20 to 64.9% by weight, preferably from 30 to 48% by weight, based on the sum of all the components of layer B. Preferably, the proportion of these low molecular weight compounds is kept very high in order to achieve good transfer and, in particular, very good bonding and fixing of the transferred toner image; in general, these compounds are at the same time responsible for the slight tack of layer B of the novel toner transfer film. We have found that the most advantageous proportion of the low molecular weight compounds is that which causes layer B as such, or at least under toner image transfer conditions, to have a slight surface tack. If the binders employed in layer B are polymeric and/or prepolymeric compounds which per se are non-tacky, the proportion of the low molecular weight ethylenically unsaturated compounds is preferably not less than about 40% by weight, based on the sum of all components of layer B. The slight surface tack of layer B is also achievable by employing ethylenically unsaturated compounds polymerizable by free radicals, in particular prepolymeric compounds, which are slightly tacky per se, as the binder. When such prepolymeric binders are used, the proportion of the low molecular weight ethylenically unsaturated compounds in layer B can of course be lower, for example from 20 to 35% by weight based on the sum of all components of layer B. It is important, in this context, that the slight tack of layer B is temporary, ie. that it disappears as a result of polymerization, such as takes place on after-treatment—as described below—of the toner transfer film after image transfer. This disappearance of tack is always observed if polymeric non-tacky binders are employed and the slight tack of layer B is due solely to the low molecular weight ethylenically unsaturated compounds contained therein. If on the other hand unsaturated prepolymeric compounds, which are slightly tacky per se, are employed as binders, this slight tack must disappear during polymerization, ie. on increase in size of the molecules. Permanently tacky or tackifying substances, whose tack does not disappear on after-treatment (as referred to above) of the toner transfer film are unsuitable for use in layer B.

In addition to the binder and the low molecular weight ethylenically unsaturated compounds, layer B of the novel toner transfer film contains one or more free radical polymerization initiators. These include compounds which decompose into free radicals on heating as well as compounds which form free radicals on irradiation with actinic light. The various types of polymerization initiators may be employed individually or as mixtures with one another. In general, layer B contains from 0.1 to 10% by weight, preferably from 0.5 to 6% by weight, based on the sum of all components of layer B, of the free radical polymerization initiators.

Amongst polymerization initiators which decompose into free radicals on exposure to heat, those having a decomposition temperature of above 60° C. but, advantageously, below 90° C. are preferred. Examples of such initiators are the known conventional azo compounds, especially 2,2'-azo-bis-isobutyronitrile, as well as the conventional peroxides and hydroperoxides, especially those of the benzoyl type, eg. benzoyl hydroperoxide and dibenzoyl peroxide.

The polymerization initiators which decompose into free radicals on exposure to actinic light in principle include all the photopolymerization initiators familiar to the skilled worker. Particularly suitable initiators have proved to be acylphosphine oxides of the general formula

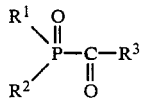

(I)

where $R^1$ is phenyl which is unsubstituted or substituted by halogen, alkyl or alkoxy, $R^2$ has the meanings of $R^1$, but $R^1$ and $R^2$ may be identical or different, and $R^3$ is tertiary alkyl of 4 to 18 carbon atoms or tertiary cycloalkyl of 5 or 6 ring carbon atoms, or cycloalkyl, aryl or 5-membered or 6-membered heterocyclic radical containing substituents X and Y at least in the two o-positions relative to the carbonyl group, X and Y being alkyl, alkoxy, alkoxyalkyl, alkylthio, cycloalkyl, aryl or halogen, and being identical or different.

Such photoinitiators are described in detail in, for example, German Laid-Open Application DOS No. 2,909,992.

Typical examples of suitable acylphosphine oxides of the general formula (I) are 2,2-dimethyl-butyroyldiphenylphosphine oxide, 2,2-dimethyl-heptanoyldiphenylphosphine oxide, 2,2-dimethyl-octanoyldiphenylphosphine oxide, 2,2-dimethylnonanoyldiphenylphosphine oxide, 2-methyl-2-ethylhexanoyldiphenylphosphine oxide, 2,6-dimethylbenzoyldiphenylphosphine oxide, 2,4,6-trimethylbenzoyldiphenylphosphine oxide and 2,6-dimethoxybenzoyldiphenylphosphine oxide.

In addition to the binder, the low molecular weight ethylenically unsaturated compounds and the polymerization initiator which forms free radicals, layer B of the novel toner transfer film may contain additives which improve the processability and/or handling characteristics of the toner transfer film. These known and conventional additives in particular include thermal polymerization inhibitors. Suitable inhibitors are all the conventional compounds, known to the skilled worker, which prevent undesired thermal polymerization, for example hydroquinone, p-methoxyphenol, p-quinone, copper-I chloride, methylene blue, β-naphthol, m-dinitrobenzene, phenothiazine, N-nitrosoamines, eg. N-nitrosodiphenylamine, and metal salts of N-cyclohexyl-N-nitrosohydroxylamine. The polymerization inhibitors may be employed individually or as mixtures with one another. They are used, in particular, if layer B contains photopolymerization initiators which decompose into radicals on exposure to actinic light. However, polymerization inhibitors may also be incorporated into layer B when thermal free radical polymerization initiators are employed, because they may, in that case, again serve to prevent undesired premature polymerization. In general, the polymerization inhibitors are present in layer B in an amount of from 0.001 to 2.0% by weight, preferably from 0.005 to 0.6% by weight, based on the sum of all components of layer B.

Layer B of the novel toner transfer film may also contain other additives alongside the thermal polymerization inhibitors. They include, in particular, additives which improve the handling, processability, surface quality and clarity of the novel toner transfer film, for example lubricants, plasticizers, inorganic or organic fillers, antioxidants and/or anti-ozone agents. Preferred additives for improving the properties of the toner transfer films are, for example, silicone oils and/or compatible plasticizers, eg. phthalic acid diesters, prepolymeric polyester-based plasticizers, soft polyacrylate resins, soft urea resins, glycerol derivatives, adipic acid esters and sulfamides. These additives are employed in conventional amounts. The total proportion of additives in layer B of the novel toner transfer film should however in general not exceed about 30% by weight, based on the sum of all components of layer B. Of course, additives which are compatible with the other components of layer B must be chosen, ie. the additves must not interfere with the clarity and transparency of layer B and hence of the toner transfer film.

To prepare the novel toner transfer film, the components of layer B are mixed homogeneously and then processed into a layer of the desired thickness. The homogeneous, essentially non-lightscattering, mixture of the individual components of layer B can be prepared by the conventional kneading, mixing and dissolving methods. For example, the components of layer B can be dissolved, conjointly or separately, in suitable solvents or solvent mixtures; if dissolved separately, the solutions are subsequently combined. The concentration of the combined solution should be such as to ensure easy processing; solids contents of from 15 to 45% by weight have proved suitable. Examples of suitable solvents are ethyl acetate, acetone, methylene chloride, ethylene chloride, chloroform, tetrahydrofuran, dioxane, toluene, xylene, butylglycol acetate and the like, employed singly or as mixtures.

The solution of the components of layer B is then cast onto the desired base A and is knife-spread uniformly so as to give, after evaaporation of the solvent or solvents, a dry layer B which is from 0.8 to 90 μm, preferably from 12 to 65 μm, thick. After evaporation of the solvent or solvents, this layer B is additionally dried, for example in a through-circulation cabinet dryer, at from 35° to 50° C. or, in special cases, at up to 80° C., in general for from about 60 to 150 minutes. However, the toner transfer film can also be prepared by first separately preparing layer B from a solution or solid mixture of the components and then laminating or pressing this layer onto the base. To achieve a firm bond between the base and the layer B it may be advantageous or even necessary also to use an adhesive layer, for example based on a commercial one-component or two-component adhesive. This adhesive layer can, for example, be applied to base A before casting or laminating layer B thereon.

For better storage and handling of the toner transfer film before it is used for toner image transfer, it is often advantageous to provide the free surface of layer B with a protective film which can easily be peeled off before image transfer. Such a film, which may, for example, consist of nylon, polyolefin, eg. polyethylene, or polyester, eg. polyethylene terephthalate or polybutylene terephthalate, is in general from about 20 to 100 μm thick. It can be applied to layer B of the toner transfer film by, for example, lamination. The adhesion between layer B and this protective film is only slight or moderate and is in every case substantially less than the adhesion between layer B and the base. The novel toner transfer films can, if such a protective film is used, be wound up in a roll, and can then be stored, even for lengthy periods, without loss of performance characteristics.

The novel toner transfer film is exceptionally suitable for transferring toner images, ie. for picking up toner images from a toner-treated surface, especially of an electrophotographic or electroradiographic recording material which has been exposed imagewise and toner-treated. The toner usually consists of polymer-coated pigment particles having a mean diameter of from about 0.05 to 100 μm, preferably from 0.8 to 45 μm. Using the novel toner transfer film it is however also possible to pick up from a surface, and transfer, any other pigment particles, or particles of a different type, having a mean diameter (weight-average) within the above range. Toner image transfer is effected as follows:

First, the protective film, if present, is peeled off the novel toner transfer film. The free surface of layer B, which serves to pick up and bind the toner image, is then brought into direct close contact with the toner-treated surface of, for example, an electrophotographic recording material which has been exposed imagewise. Advantageously, this contact is effected by means of a pressure roller, employing a pressure of from 0.2 to 4 bar, preferably from 0.6 to 2 bar, for transfer. The toner transfer film is then lifted off the surface of the electrophotographic recording material, with the toner adhering to layer B of the toner transfer film. The toner image which has thus been transferred from the toner-treated surface—for example, of an electrophotographic recording material—onto the toner transfer film can easily be bonded to the novel transfer film, and accordingly permanently fixed, by a simple after-treatment. For this purpose, the film, after toner image transfer, is either briefly heated to above the decomposition temperature of the free radical initiator and/or exposed to actinic light, depending on the nature of the polymerization initiator present in layer B. This treatment polymerizes the low molecular weight ethylenically unsaturated compounds contained in layer B, so that the transferred toner particles, which as a result of the transfer became embedded in the layer B, are permanently bonded to this layer and are thus fixed. If the toner transfer film contains unsaturated binders capable of free radical polymerization or crosslinking, these binders participate in the polymerization occurring during the above after-treatment, and may thereby improve bonding of the toner particles. If layer B of the toner transfer film contains a polymerization initiator which decomposes into free radicals on exposure to heat, the film must, during after-treatment, ie. after toner image transfer, be heated to not less than the decomposition temperature of the initiator. On the other hand, the temperature to which it is heated should not be excessively above the said decomposition temperature, so as not to overstress the product. In general, it has proved adequate and advantageous to carry out the after-treatment at from 60° to 100° C., preferably from 80° to 90° C. If layer B contains photopolymerization initiators, the after-treatment includes exposing the entire surface of the toner transfer film to actinic light. All conventional radiation sources of actinic light can be used for this purpose; the wavelength of the emitted light is in general from 230 to 450 nm, especially from 300 to 420 nm, and is preferably chosen in accordance with the intrinsic absorption of the photopolymerization initiator present in layer B. The duration of heating and/or exposure of the toner transfer film during after-treatment should be such as to ensure that the polymerizable compounds present in layer B are substantially completely polymerized. We have found that for thermal after-treatment from about 2 to 10 minutes generally suffices, whilst for after-treatment with actinic light from one to 2 minutes generally suffices.

It has proved particularly advantageous to carry out the after-treatment of the toner transfer film, in order to fix the transferred toner image, whilst the toner transfer film is still associated with the electrophotographic material, ie. when the toner image has already been transferred but the toner transfer film has not yet been peeled off the surface of the electrophotographic recording material. This method is, in particular, advantageous and simple to carry out if layer B of the toner transfer film contains photopolymerization initiators. In that case, the transferred toner image is fixed by after-treating the toner transfer film, which is still associated with the electrophotographic element, by irradiation with actinic light from the rear, ie. through the base A, and only then peeling it off the electrophotographic recording material.

The after-treatment fixes the transferred toner image firmly and permanently in the toner transfer film. It is a particular advantage that the transferred and fixed toner image is bonded in a completely abrasion-resistant manner to the toner transfer film. The after-treated film per se is non-tacky and moreover very resistant to yellowing, so that even lengthy storage does not interfere with the information content. Even subsequent to after-treatment by heating and/or exposure to light, the novel toner transfer film is transparent and clear in the zones not covered by the toner image. Since, using the novel toner transfer film, the contours of the toner image can be transferred without loss of definition or of information, the novel toner transfer film can, after image transfer and fixing, be very effectively used directly for example as a positive or negative in reprography, in X-ray diagnostics and in similar sectors.

The Examples which follow illustrate the present invention. Parts and percentages are by weight, unless stated otherwise. Parts by volume bear the same relation to parts by weight as the liter to the kilogram.

The percentage of toner transferred, based on the amount of toner originally present, is determined gravimetrically from the proportion of toner remaining on the surface of the electrophotographic recording material after toner image transfer, or from determination of the optical densities of the transferred image and the residual image. The determination is carried out on large areas which have been treated overall with toner. The tack of the toner transfer film is measured in terms of the adhesion of a polyester film laminated onto the surface of layer B of the toner transfer film. The yellowing tendency is determined in terms of the change in optical density, in the visible wavelength range, over a lengthy period of time.

EXAMPLE 1

50 g of a polyester-acrylate having a mean molecular weight of 800 are dissolved, together with 5% of benzoyl peroxide, in a 70:30 tetrahydrofuran/toluene mixture. This solution, of 30% solids content, is knife-coated onto a clear 125 μm thick polyester film in an amount which, after the solvent has evaporated, leaves a 15 μm thick layer. The resulting toner transfer film is then dried for 2 hours at 35° C. in a through-circulation cabinet dryer.

After drying, the surface of the toner transfer film is slightly tacky; a 40 μm thick polyester film strip, 2 cm wide, laminated thereon can be peeled off by applying a force of 110 p. If the tacky surface of the film is brought into direct close contact with a toner-treated surface of an electrophotographic recording element which has been exposed imagewise, the image is transferred faithfully, and the degree of toner transfer is found experimentally to be about 82%. After transfer, the film is kept in the cabinet layer at 75°–80° C. for about 15 minutes. The surface of the toner transfer film is then found to be non-tacky, with the toner fixed in an abrasion-resistant manner.

EXAMPLE 2

20 g of a styrene/isoprene/butadiene three-block copolymer of the A-B-C type (A: styrene polymer block, B: isoprene polymer block, C: butadiene/styrene copolymer block), containing, as polymerized units, about 17% of styrene, about 76% of isoprene and about 7% of butadiene, are dissolved, together with 22%, based on total mixed solids, of hexanediol dimethacrylate and 4%, based on total mixed solids, of 2,2-dimethyloctanecarbonyldiphenylphosphine oxide, in a 2:1 toluene/tetrahydrofuran mixture, and the solution is used to prepare a toner transfer film similarly to Example 1. After having allowed the solvents to evaporate, the film is dried at 80° C. for 15 minutes. At this stage, the surface is slightly tacky; a polyester film strip 40 μm thick and 2 cm wide, laminated onto the surface, requires a force of about 200 p to peel it off.

This toner transfer film is used, as described in Example 1, to transfer a toner image; the experimentally determined degree of toner transfer is about 88% and the transferred image is a faithful reproduction of the original toner image on the electrophotographic recording material. After transfer, the toner transfer film is heated to 80° C. and exposed, at this temperature, to actinic light (2,000 $\mu Wcm^{-2}$) for 1 minute. After this treatment, the toner is abrasion-resistant and the surface of the toner transfer film is virtually non-tacky.

EXAMPLE 3

43 g of a mixture of 2 parts of a polymethylmethacrylate of mean molecular weight 90,000 and one part of a polymethylmethacrylate of mean molecular weight 350,000 are dissolved in a mixture of 210 g of tetrahydrofuran and 90 g of toluene, and 38 g of glycerol dimethacrylate, 3.5 g of trimethylolpropane triacrylate, 10.0 g of a polyester of mean molecular weight 6,000, 5.0 g of 2,4,6-trimethylbenzoyl-diphenylphosphine oxide, 0.25 g of hydroquinone monomethyl ether and 1.0 g of a silicone oil are added. A toner transfer film is prepared with this mixture by the method described in Example 2, the thickness of the dry layer B being 40 μm. After drying, the surface of the film is very slightly tacky; a polyester film strip, 40 μm thick and 2 cm wide, laminated thereto requires a force of 65 p to peel it off.

On transferring a toner image by means of this toner transfer film, about 93% of the toner is transferred from the electrophotographic recording material to the film. There is no detectable loss of information as a result of this transfer. After having heated the toner transfer film to about 80° C., with simultaneous exposure to actinic light for about 1 minute, the toner is found to have been fixed in an abrasion-resistant manner. The surface of the toner film which has been after-treated in this way is non-tacky.

EXAMPLE 4

10 g of a polyurethane acrylate (molecular weight 1,800) are dissolved in 120 ml of tetrahydrofuran, 0.2 g of 2,2-dimethyloctanecarbonyl-diphenylphosphine oxide and 0.2 g of benzoyl peroxide are added and the solution is mixed with 3 g of tetraethylene glycol dimethacrylate. The resulting solution is used to prepare a toner transfer film by the process described in Example 1. The coating is dried at 35° C.

With this film, a toner image can be transferred from the electrophotographic element to the extent of about 92%, and be fixed durably by simultaneous exposure to actinic light and heating to 80° C. The toner-free areas are non-tacky after exposure and heat treatment.

EXAMPLE 5

60 parts of trimethylolpropane triacrylate, 40 parts of tetraethylene glycol dimethacrylate, 3.6%, based on total additives, of trimethylbenzoyl-diphenylphosphine oxide, 0.3% (based on total additves) of hydroquinone monomethyl ether, 0.08% (based on total additives) of N-nitrodiphenylamine, 8.3% (based on total additives) of dimethyl phthalate and 4.5% (based on total additives) of a polyester of molecular weight 6,000 are added to a mixture of 23.4% (based on total binder) of a polymethyl methacrylate of molecular weight about 480,000, 13% (based on total binder) of a polymethyl methacrylate of molecular weight about 95,000, 16% (based on total binder) of a polymethyl methacrylate of molecular weight about 370,000, 23% (based on total binder) of a methyl methacrylate/ethyl acrylate copolymer having a glass transition temperature of 61° C. and 24.6% (based on total binder) of a polyethyl methacrylate having a glass transition temperature of 61° C., in a 2:1 solvent mixture of tetrahydrofuran and toluene; the ratio of total binder to total monomers is 15:13.

This solution is used to prepare, similarly to Example 1, a toner transfer film having a 55 μm thick transfer layer. With this film, a more than 98% toner transfer can be achieved. After one minute's exposure to light at room temperature, the toner is found to have been bonded in an abrasion-resistant manner, whilst the toner-free surface is non-tacky. The optical density of the transfer image is about 3. The film is exceptionally suitable for use in reprography.

We claim:

1. A toner transfer film for picking up a toner image from a toner-treated surface and then fixing the transferred toner image, which consists essentially of A. a clear, transparent base having a thickness of about 70–205 μm, and B. a layer, firmly anchored thereto, which is also clear and transparent and is capable of picking up the toner image, which layer is solid and substantially colorless, has a temporary slight surface tack at least under the conditions of toner image transfer, has a thickness of about 0.8–90 μm and consists essentially of 1. 35–75% by weight, based on the sum of the conponents of layer B, of at least one polymeric and/or prepolymeric binder,
2. 20–64.9% by weight, based on the sum of the components of layer B, of at least one low molecular weight, ethylenically unsaturated compound which is polymerizable by free radicals and has a boiling point above 100° C. at atmospheric pressure,
3. from 0.1 to 10% by weight, based on the sum of the components of layer B, of at least one polymerization initiator which can be activated by heat and has a decomposition temperature above 60° C. and at least one polymerization initiator which can be activated by light but not by heat and forms free radicals, and
4. from 0 to 30% by weight, based on the sum of the components of layer B, of additives.

2. A process for producing a durable negative or positive via a toner image, by picking up the toner image, by means of a toner transfer film, from a toner-treated surface, especially of an electrophotographic recording material which has been exposed imagewise, and fixing the toner image to the toner transfer film, wherein the toner image is picked up from the toner-treated surface by means of a toner transfer film, which consists essentially of A. a clear, transparent base having a thickness of about 70–205 μm, and B. a layer, firmly anchored thereto, which is also clear and transparent and is capable of picking up the toner image, which layer is solid and substantially colorless, has a temporary slight surface tack at least under the conditions of toner image transfer, has a thickness of about 0.8–90 μm and consists essentially of (1) 35–75% by weight, based on the sum of the components of layer B, of at least one polymeric and/or prepolymeric binder, (2) 20–64.9% by weight, based on the sum of the components of layer B, of at least one low molecular weight, ethylenically unsaturated compound which is polymerizable by free radicals and has a boiling point above 100° C. at atmospheric pressure, (3) from 0.1 to 10% by weight, based on the sum of the components of layer B, of at least one polymerization initiator which can be activated by heat and at least one polymerization initiator which can be activated by light and forms free radicals, and (4) from 0 to 30% by weight, based on the sum of the components of layer B, of additives and thereafter the toner transfer film carrying the toner image is subjected to an after-treatment comprising the application of heat and exposure to light.

3. The process of claim 2, wherein the initiator which can be activated by heat is benzoyl peroxide and the initiator which can be activated by light is an acylphosphine oxide.

* * * * *